US005225619A

United States Patent [19]

Sharp

[11] Patent Number: 5,225,619

[45] Date of Patent: Jul. 6, 1993

[54] METHOD AND APPARATUS FOR RANDOMLY READING WAVEFORM SEGMENTS FROM A MEMORY

[75] Inventor: Paul H. Sharp, Aloha, Oreg.

[73] Assignee: Rodgers Instrument Corporation, Hillsboro, Oreg.

[21] Appl. No.: 611,408

[22] Filed: Nov. 9, 1990

[51] Int. Cl.[5] ..... G10H 7/04

[52] U.S. Cl. ..... 84/604; 84/622

[58] Field of Search ..... 84/604-607, 84/622

[56] References Cited

U.S. PATENT DOCUMENTS

| | | | |
|---|---|---|---|
| 3,255,297 | 6/1966 | Long . | |
| 3,778,525 | 12/1973 | Chase et al. . | |
| 4,008,641 | 2/1977 | Takada et al. . | |
| 4,442,745 | 4/1984 | Gross et al. | 84/607 |
| 4,502,361 | 3/1985 | Viitanen et al. | 84/627 |
| 4,524,666 | 6/1985 | Kato | 84/DIG. 12 |
| 4,785,702 | 11/1988 | Katoh | 84/604 |
| 4,984,496 | 1/1991 | Beacham et al. | 84/622 X |
| 5,020,410 | 6/1991 | Sasaki | 84/622 X |
| 5,027,687 | 7/1991 | Iwamatsu | 84/622 X |
| 5,027,689 | 7/1991 | Fujimori | 84/622 |
| 5,044,251 | 9/1991 | Matsuda et al. | 84/622 X |

*Primary Examiner*—William M. Shoop, Jr.
*Assistant Examiner*—Brian Sircus
*Attorney, Agent, or Firm*—Edward B. Anderson

[57] ABSTRACT

An electronic musical instrument has a plurality of oscillators. Each oscillator reads out segments of a waveform stored in memory using a random selection method. In one method the loop or start address is selected at random and the selection of a new address may be one cycle from the loop address or may be a repeat of the prior end address. In another method, both the loop and end addresses are randomly selected. Further, the end address is repeated a number of times determined randomly within a defined range of numbers.

26 Claims, 3 Drawing Sheets

METHOD AND APPARATUS FOR RANDOMLY READING WAVEFORM SEGMENTS FROM A MEMORY

FIELD OF THE INVENTION

This invention relates to electronic musical instruments, and in particular to such instruments and methods for selecting waveform segments randomly for reading from a waveform memory.

BACKGROUND OF THE INVENTION

Electronic music instruments, such as electronic organs and synthesizers of various forms, have become very sophisticated in being able to digitally store a waveform formed of individually addressable samples. When the samples are read sequentially and converted into a signal for audio play through a speaker, a tone or sound is created representative of the stored waveform.

The desired objective, in terms of replicating actual acoustic instruments, is to make the replicated sound, sound as natural or life-like as possible while making the instrument as economical as possible. This is generally accomplished by providing a bank of oscillators or note generators that are fewer in number than the maximum number of actuating keys and stops. Also, the smaller the memory storing the waveforms, the less expensive the instrument.

With less than the complete sound stored in memory,. it is difficult to reproduce this limited waveform in a manner that is truly life-like. One technique that has been developed is to generate waveform segments with a random process. This randomness then produces a randomness in the sound that is representative of some musical instruments, such as pipe organs and cymbals. Further, the random process prevents the introduction of artificial modulation effects from the process itself.

As an example, in U.S. Pat. No. 4,442,745, Gross et al. describe a process of repeating a portion of a waveform memory by progressing through the memory in a forward/reverse cycling that is pseudorandom in nature, followed by a pseudorandom repeating of a predetermined end portion of the waveform memory. The pattern of reading is generated from a memory table that stores the start and end addresses of each of the waveform segments that are read. This technique is not truly random since the pattern prevents returning to previously readout sections. Thus, any inherent characteristics in the waveform that change with time are essentially maintained.

Viitanen et al., in U.S. Pat. No. 4,502,361, disclose random recycling techniques in which the memory is read in a forward direction only. In one technique, the start address is randomly selected and the end address is always the end of the stored waveform. This results in the end of the waveform being read all the time, resulting in a repeating sound that does not vary. Alternatively, randomly selected single cycles of equal length are read. This technique results in the opposite effect in that sequentially read cycles are completely unrelated, producing a sense of discontinuity in the resulting sound. Many natural sounds have pitch gitter which equates to cycles of different lengths. Random looping with single cycles of equal length prevents pitch change.

Kato, in U.S. Pat. No. 4,524,666, provides a variation of this technique by generating a random number that is added to a set repeat address to produce a waveform segment start or loop address. In one embodiment only one complete steady-state cycle is used, in another embodiment four cycles are used. In this latter embodiment, as with an embodiment of Viitanen et al., the end address is always the end of the waveform. This again results in a repeating of the end waveform with every repeat loop through memory.

Katoh, in U.S. Pat. No. 4,785,702, discloses separately storing predefined sections of a recorded sound with each section having a plurality of periods. The sections are then randomly selected for readout. In order to generate a truly random sound, it is necessary to have a large memory in order to have enough sections. Further, unless the waveforms in the different sections are made to have some similarity, the resulting sound will have discontinuity.

In many musical instruments, the randomness is applied to a progressively and continuously varying base sound. Thus, these techniques will result in either no continuity between repeated loops or sections of memory, or will continuously repeat a portion of the memory in every loop cycle.

What is needed therefore is an electronic musical instrument and method for randomly selecting waveform segments from a stored waveform that maintains some continuity, even intermittently, as the waveform segments are read out. This would make apparent some time-varying characteristic of the natural sound.

SUMMARY OF THE INVENTION

This is provided in the present invention by an electronic musical instrument and method for randomly reading waveform segments of a stored waveform. The method includes the step of storing in a memory at sequential addresses a waveform having a plurality of cycles, with each cycle having a plurality of addressable samples, each cycle being identified by a start address and an end address. A plurality of waveform segments stored in the memory are sequentially randomly selected, with each segment having at least one cycle and being defined by a start address and an end address.

This is provided by selecting start and end addresses associated with each waveform segment, with at least one address of the start and end addresses being changed between sequentially adjacent waveform segments more than the other address of the start and end addresses so that sequentially adjacent selected waveform segments exist having at least one common cycle. Waveform segments associated with the selected waveform segments are then sequentially read.

In a preferred method of practicing the present invention, at least one of the start and end addresses of a first waveform segment is stored in the memory. A waveform segment associated with the first waveform segment is read by sequentially selecting as a current address an address associated with the first waveform segment, reading the value of the sample stored in the memory at the current address, and sequentially incrementing the current address to the address of another sample and reading the incremented current address.

The start or loop address of each subsequent waveform segment is sequentially and randomly selected at predetermined intervals. When the end address of each subsequent waveform segment is sequentially subsequent in the memory from the current address at the time the subsequent waveform segment address is selected, samples stored in memory between the current address and the subsequent waveform segment address are read.

When a selected end address of a subsequent waveform segment is sequentially precedent in the memory from the current address at the time the subsequent waveform segment address is selected, the end address of the previous waveform segment is repeated. Samples stored in memory between the current address and the repeated end address are read and then the samples of the selected waveform segment between the start and repeated end addresses are read, until the next waveform segment addresses are selected.

It will be seen that such an instrument and method repeats portions of waveform segments when a certain relationship exists between the current address being read and the otherwise randomly selected end address. Further, when a new address is located ahead of the current address, interim waveform segments are read. This also provides a continuity to the resulting sound.

One particularly advantageous application of this technique is in the generation of stereo sound using a separate oscillator for each speaker. The independently randomized sound has a very pleasing and natural ambience.

These and other features and advantages of the present invention will be apparent from the following detailed description of the preferred embodiment and associated drawings.

DETAILED DESCRIPTION OF THE PREFERRED EMBODIMENT

Figures 1, 2:
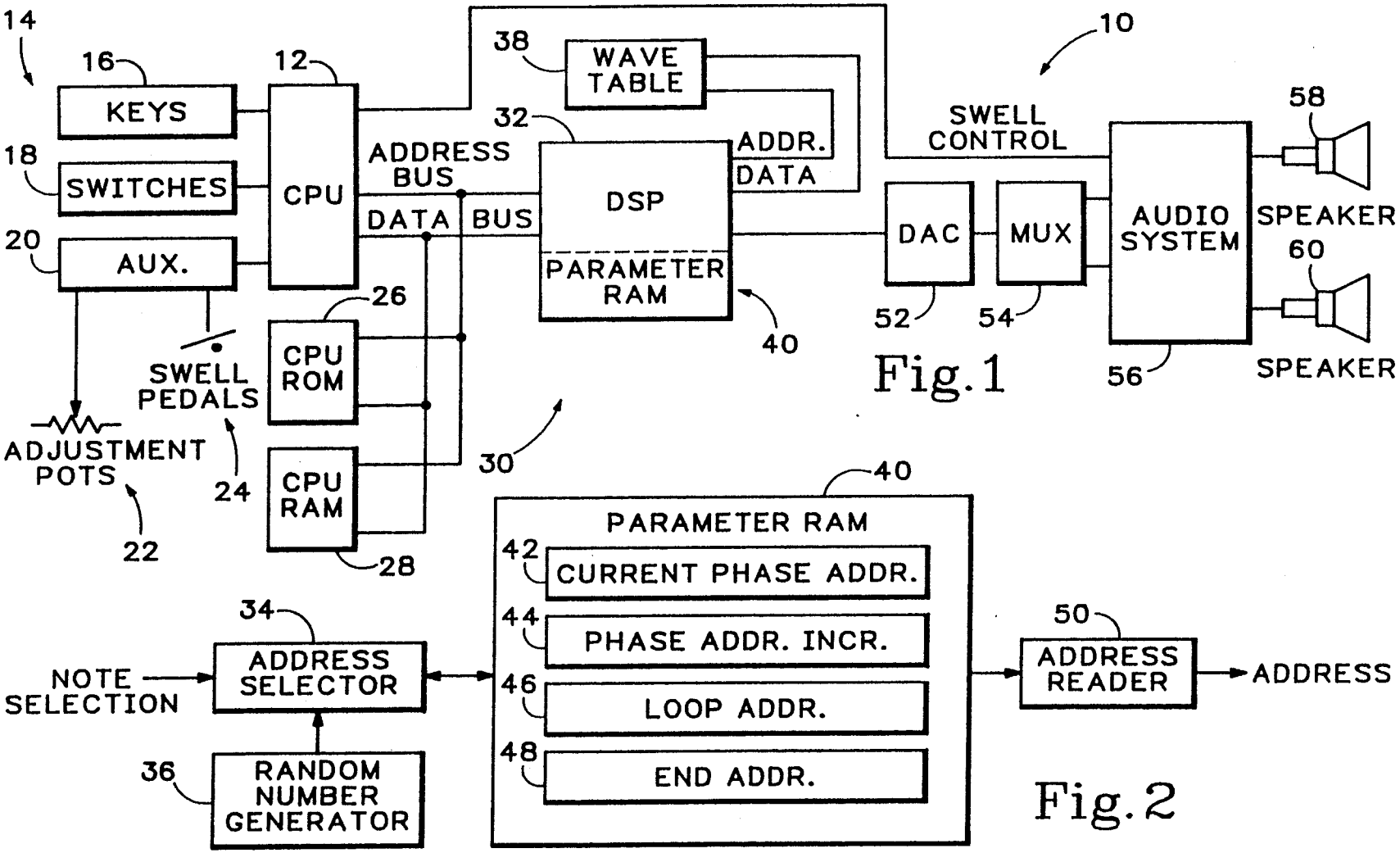
FIG. 1 is a block diagram of an electronic musical instrument made according to the invention.
FIG. 2 is a block diagram of relevant functional portions of a digital signal processor used in the instrument of FIG. 1.

Referring initially to FIG. 1, an electronic music instrument 10, such as a music synthesizer or electronic organ, is shown. The structure and operation of electronic music instruments is well known in the art, as is exemplified by the patents discussed previously. Instrument 10 is therefore discussed herein generically, with emphasis on those features of particular relevance to an apparatus for practicing the present invention.

Instrument 10 includes a central processor unit (CPU) 12 that controls the sensing of control or input devices, shown generally at 14, for input instructions into the CPU during operation. Input devices 14, in an electronic organ, typically include a plurality, such as 61, of keys 16 of a keyboard, and switches or stops 18 and auxiliary controls 20 responsive to adjustment pots 22 and swell pedals 24 for further controlling the voices or sounds generated in response to activation of the keys.

The CPU is coupled to appropriate memory devices, such as a read-only memory (ROM) 26 that stores programs and fixed data, and a read/write or random-access memory (RAM) 28 that stores changeable data. Instrument 12 is a timeshared tone-generating system that preferably contains 32 oscillators or note generators, such as the oscillator shown generally at 30. Control information is conveyed from the CPU to a digital-signal processor (DSP) 32 that forms parts of the oscillators. It may be a commercially available integrated circuit or a combination of circuits providing generally known digital data manipulation as controlled by the processor.

As particularly shown in FIG. 2, the DSP includes, as part of oscillator 30, an address selector 34 that is responsive to a signal from the processor generated when an instruction is input selecting a desired output note. In response to random numbers produced by a random number generator 36, the address selector selects start and end addresses of a waveform segment corresponding to the selected note, which waveform segment is stored in a wave table 38. The wave table has separately addressable memories (not shown), each storing a waveform as is illustrated by the remaining figures.

The address selector sets initial values for addresses in a parameter RAM 40 contained within the DSP. Specifically, for purposes of illustrating the present invention, RAM 40 includes a current phase or sample address register 42, a phase address increment register 44, a loop or start address register 46, and an end address register 48. Use of these registers will be described with reference to the waveforms shown in the remaining figures.

An address reader 50 uses the values in these registers during reading of the waveforms stored in wave table 38. The waveform samples addressed by reader 50 are output to a digital-to-analog converter (DAC) 52 that converts digital values into an analog signal, as is well known in the industry. The analog signal is then fed by a multiplexer 54 into one of two speaker channels of an audio system 56 that modulates the signals as desired, such as with a swell control signal received from processor 12, as shown, and outputs them to stereo speakers 58 and 60.

Figure 3:
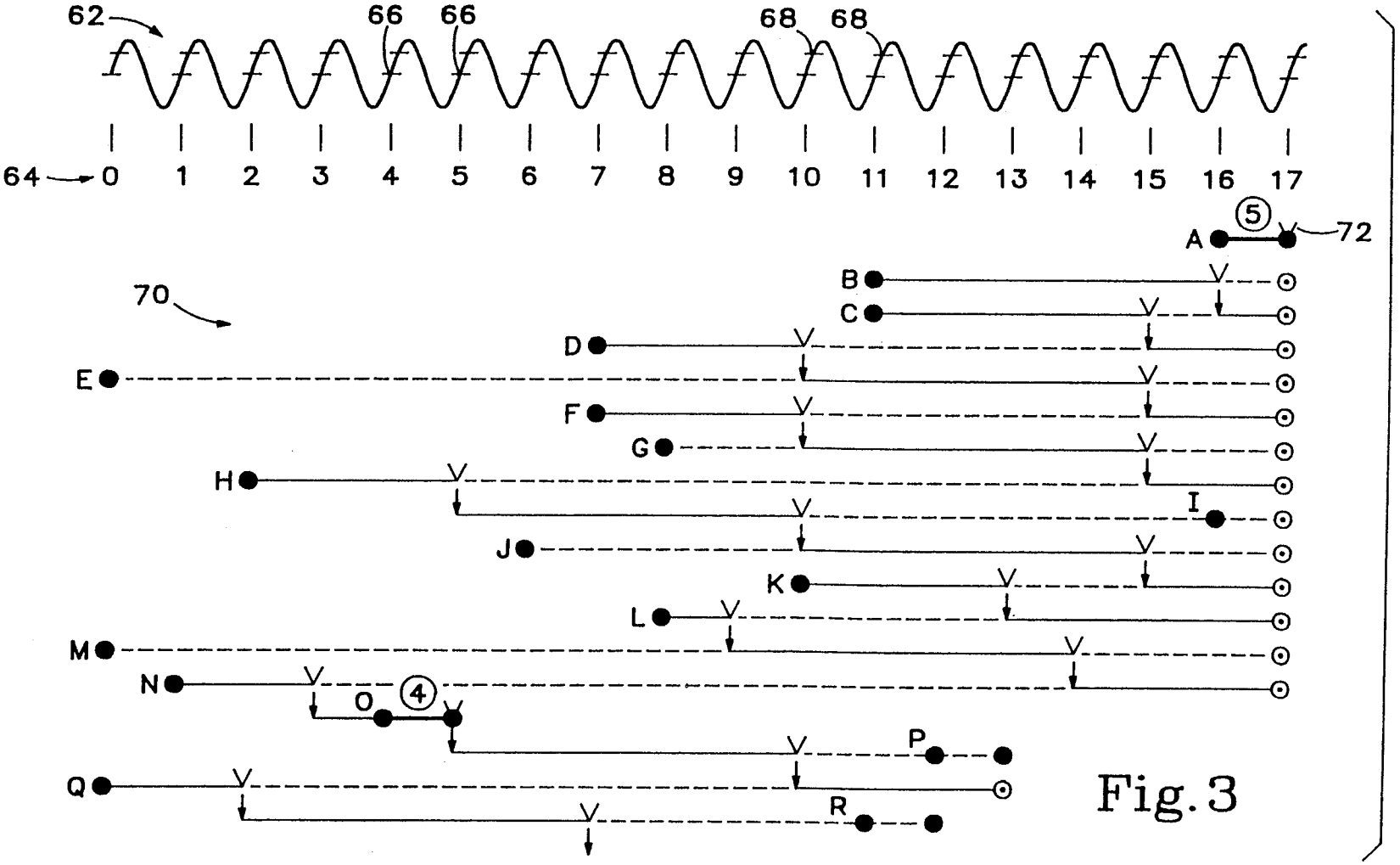
FIG. 3 is an exemplary waveform storable in the wave table of the instrument of FIG. 1 and associated exemplary looping sequence for reading the waveform according to a first preferred method of practicing the invention.

Referring now to FIG. 3, a waveform, such as waveform 62, is stored in wave table 38 for each oscillator. The waveform shown represents a simple sine wave, but may also have a preceding attack portion, and would have characteristics of a natural instrument sound that is represents.

Waveform 62 is divided into a plurality of cycles, such as the 17 cycles shown. These cycles are stored in memory at address locations identified for purposes of discussion by the sequential numbers shown below them. The addresses, shown generally at 64, identify amplitude samples that are used to start or end the cycles. The addresses shown can thus identify zero crossings of the amplitude samples, such as zero crossings 66. They could also be associated with samples having nonzero amplitudes, such as crossings 68. So long as the amplitude and slope are substantially the same for each cycle, there will be minimal artificial noise resulting from the transition from one cycle to a nonsequentially subsequent cycle, such as from the cycle ending at address 12 to the cycle beginning at address 7, or any other such combination.

In the method of the invention illustrated by the scan sequence 70, a first waveform segment A is selected by address selector 34 in response to a random number received from generator 36. A waveform segment has one or a plurality of cycles and is identified by the corresponding start or loop address of the first cycle and the end address of the last cycle in the segment.

The start address of the segment is randomly selected, such as address 16 of the segment identified as A. The signal processor then sets the end address at the end of the first cycle unless certain conditions exist. In this first segment, 17 is the end address of memory and the end address of the cycle beginning at 16, so the value set in end address register 48 is 17.

The solid dots at the beginning and end of segment A represent the address values set in loop and end registers 46 and 48. The current phase address in register 42 is the address of the waveform sample in wave table 38 that is currently being read. After a current phase sample is read, the current phase address is incremented by the phase address increment that is fixed for the note being generated, and is stored in register 44. The current phase address is initially set equal to the loop address and then incremented for reading the samples associated with the identified waveform segment.

After each increment of the current phase address, the new current phase address is compared to the end address. If it is less than the end address the current phase address is set in register 42 and the sample read from memory by address reader 50. If the new current phase address is past the end address, then the current phase address is set equal to the loop address plus the difference between the end address and the attempted new current phase address (the amount the new current phase address was past the end address).

In the present method, a new start address is assigned at periodic intervals. In the illustrated method, this time period is equal to the time for five cycles to be read from memory. This time period can be varied, and could be randomly selected. Since scan A is a single cycle, it is read five times before a new loop address is selected. The heavy line and circled number over the line indicates that the segment is repeated five times. The current phase address at the time of setting the new loop address is represented by the "V" symbol 72.

The loop address for scan B is 11. The desired end address for a single-cycle waveform segment is 12. However, address 12 is sequentially precedent to the current phase address of 17 existing at the time of the new address selection. Thus, rather than assigning the new end address, the existing end address is repeated or reselected, so that the new waveform segment for scanning is actually the set of cycles between addresses 11 and 17.

The next current phase address assignment is then 11 plus the phase increment, since the current phase address was at the end of the previous waveform segment when the new loop address was selected.

Only a portion of segment B is read before the next loop address is selected. Segment C has the same loop address. Since the current phase address is still forward in memory from the desired end address of 12, 17 is retained as the end address again. The last cycle of segment C is read and then the first four cycles are read before the loop address for segment D is selected. The unread portion of the segment is represented by dashed lines.

As can be seen in reviewing the segments C through N, the current phase address is never within one cycle of the new loop address when the new loop address is selected, so the end address of 17 is retained for all of these segments. Further, since the current phase address was below the end address when segment I is initiated, the current phase continues to increment toward the end address even though it is less than the loop address of 16. This results from the new current phase addresses only being compared to the end address. The loop address is ignored until the end address is exceeded. This results in a continuous reading of waveform 62 during segments H, I, J and part of K.

It is not until segment O that the current phase address is sequentially precedent to the new end address of 5. This new end address is thus selected. Segment P has even later addresses and the new loop and end addresses of 12 and 13 are selected even though the segment read is earlier. Segment Q has a loop address of O which is well in advance of the current phase address when the new loop address is selected, so the end address of segment P is repeated for segment Q, as shown.

This scanning method thus results in the end address being repeated while the loop address is changed. As can be seen in FIG. 3, this results in a repeating of portions of some of the segments, as actually read, more often than if only single cycle segments were read. Further, the process of migrating forward, rather than discrete jumps, such as when segments associated with segments O and P are read, results in a continuous reading of the waveform for different segments. This also provides for a smoother or more natural sound progression in conjunction with the random selection of loop addresses.

The table below lists the sequences shown in FIG. 3 and the address selections associated with it. It also shows the values used in FIG. 4, explained below.

TABLE OF ADDRESS ASSIGNMENTS

Figure 4:
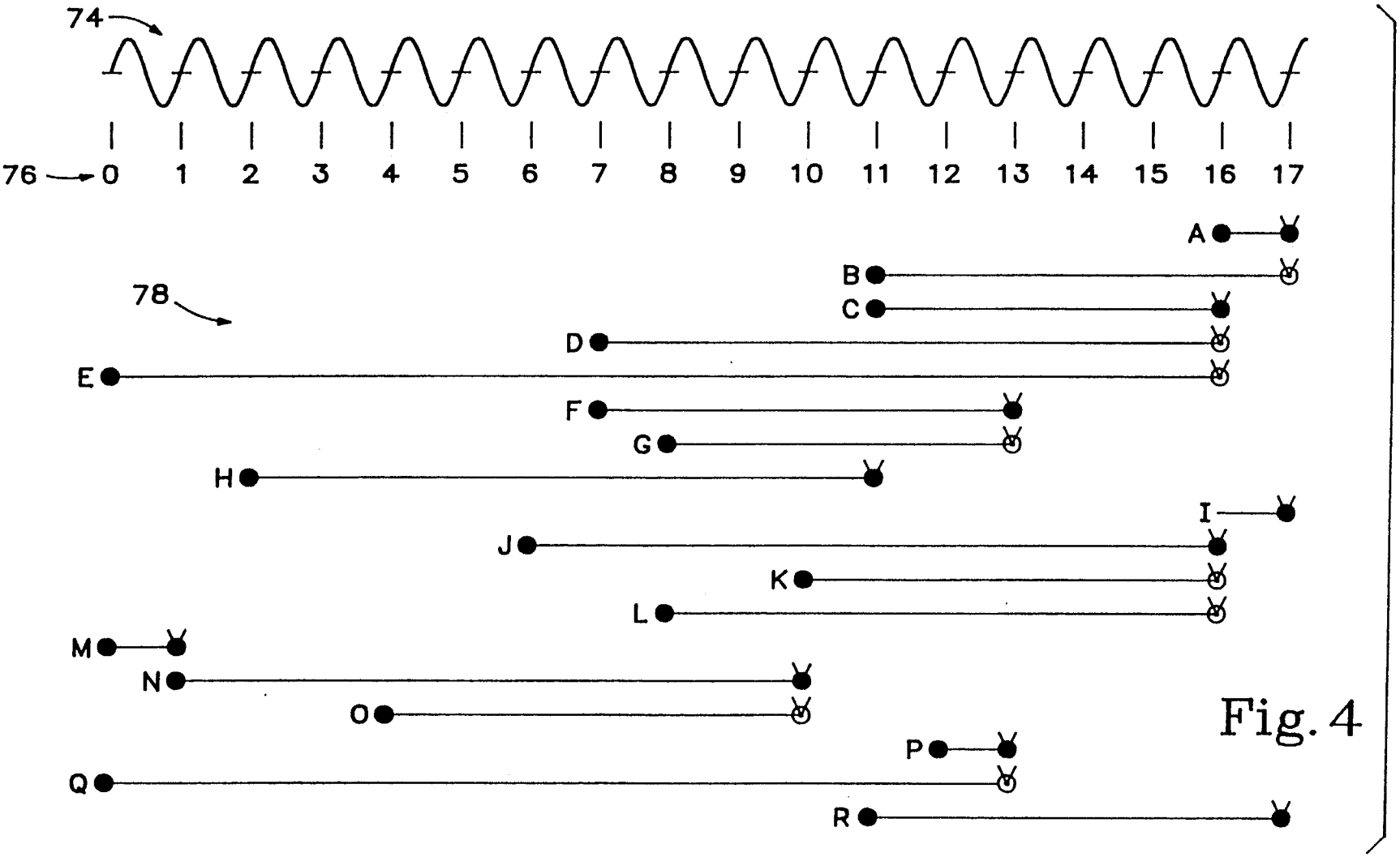
FIG. 4 is an exemplary waveform storable in the wave table of the instrument of FIG. 1 and associated exemplary looping sequence for reading the waveform according to a second preferred method of practicing the invention.

| SEQUENCE | RANDOM LOOP | FIG. 3 SINGLE CYCLE WITH MIGRATING END | FIG. 4 RANDOM DISCRETE END | NO. OF END REPEATS |
|---|---|---|---|---|
| A | 16 | 17 | 17 | 2 |
| B | 11 | 17 | 17 | |
| C | 11 | 17 | 16 | 3 |
| D | 07 | 17 | 16 | |
| E | 00 | 17 | 16 | |
| F | 07 | 17 | 13 | 2 |
| G | 08 | 17 | 13 | |
| H | 02 | 17 | 11 | 1 |
| I | 16 | 17 | 17 | 1 |
| J | 06 | 17 | 16 | 3 |
| K | 10 | 17 | 16 | |
| L | 08 | 17 | 16 | |
| M | 00 | 17 | 01 | 1 |
| N | 01 | 17 | 10 | 2 |
| O | 04 | 05 | 10 | |
| P | 12 | 13 | 13 | 2 |
| Q | 00 | 13 | 13 | |
| R | 11 | 12 | 17 | 1 |

Referring now to FIG. 4, a waveform 74 is shown that is the same as waveform 62 of FIG. 3. The addresses 76 are also the same, as is the scan sequence 78 of segments A through R. As shown in the table, the methods of FIGS. 3 and 4 are shown with the same sequence of loop addresses. However, this method provides for random selection of the end address, which must be at least one cycle greater than the loop address, and for a repeating of the end cycles. The number of times of repeating of an end address when first selected is randomly selected between 1 and 3, inclusive. Other numbers of repetitions could also be used.

Each segment is read from the loop address to the end address, at which time new loop and end addresses are selected, and read completely, as shown. An instrument 10 made to practice this method has a random number generator that produces the three random numbers. An alternative approach is the storing of preset pseudorandom addresses as taught by Gross et al. in U.S. Pat. No. 4,442,745. The process of moving between discrete addresses is taught in the prior art, such as by Viitanen et al. in U.S. Pat. No. 4,502,361 (as well as the use of random number generators), or in my copending application owned by the same assignee as the present application filed on the same date and entitled "Method and Apparatus for Reading Selected Waveform Segments from Memory".

By repeating the end addresses, portions of sequentially adjacent waveform segments are the same. That is, whenever an end address is repeated, at least one cycle is also repeated. Loop addresses could be repeated instead, with the same effect. The result, as with the method illustrated with reference to FIG. 3, is a continuity in some of the sounds as the waveform segments are played. This results in a sound that is pleasing to the ear, while avoiding artificial sound variations that might result from a periodic playing of waveform segments, or the monotony of always repeating a portion of the waveform in every waveform segment scan.

The waveforms and methods described with reference to FIGS. 3 and 4 are illustrative rather than limiting. Other scan sequences, waveforms, waveform segment selections, cycle definitions and sequence logic can also be used.

A further application of these techniques is the use of them in a stereo system, as is illustrated in FIG. 1. Separate oscillators 30 are used for each stereo channel. The same waveform is used to produce the two sounds, but the sounds are generated using different random numbers. The result, in part, is that the separate sounds produced in speakers 58 and 60 have characteristics of different waveform segments. When the stored waveform is a copy of a sampled natural sound, then variations in pitch, timbre, modulation, and phase or time delay, as occur naturally, exist in the two sounds. This has been found to create a very pleasing ambience in the combined sound from the speakers.

It will thus be apparent to one skilled in the art that variations in form and detail may be made in the preferred embodiments and methods of practicing the invention without varying from the spirit and scope of the invention as defined in the claims.

I claim:

1. A method for randomly reading waveform segments of a waveform stored in memory of a digital electronic musical instrument comprising the steps of:

storing in a memory of an electronic musical instrument at sequential addresses a waveform having a plurality of cycles, with each cycle having a plurality of addressable samples, each cycle being identified by a start address and an end address;

sequentially randomly selecting a first plurality of waveform segments stored in the memory, with each segment having at least one cycle and being defined by a start address and an end address, by selecting start and end addresses associated with each waveform segment, with both start and end addresses being selected randomly and at least one address of the start and end addresses being changed between sequentially adjacent waveform segments more than the other address of the start and end addresses so that sequentially adjacent selected waveform segments exist having at least one common cycle; and sequentially reading waveform segments associated with the selected waveform segments.

2. A method according to claim 1 further including, each time the other address is changed, selecting the number of sequential waveform segments for which the other address will be repeated.

3. A method according to claim 2 wherein the step of selecting includes randomly selecting the number of sequential waveform segments for which the other address will repeat.

4. A method according to claim 3 wherein the step of randomly selecting the number of sequential waveform segments for which the other address will repeat includes selecting the number from within a range of preselected numbers.

5. A method according to claim 4 wherein the step of selecting the other address includes randomly selecting the other address.

6. A method according to claim 1 wherein the step of selecting the other address includes randomly selecting the other address.

7. A method according to claim 1 wherein the step of selecting the start and end addresses includes selecting the start and end addresses at selected intervals of time independent of the reading of the waveform segments.

8. A method according to claim 1 wherein the step of selecting the start and end addresses includes selecting the start and end addresses at periodic intervals of time.

9. A method according to claim 1 wherein the step of reading includes reading sequential samples of waveform segments stored in memory by sequentially selecting as a current address an address associated with a current waveform segment, reading the value of the sample stored in the memory at the current address, and sequentially incrementing the current address to the address of another sample and reading the incremented address; and when the end address of each subsequent waveform segment is sequentially subsequent in the memory from the current address at the time the subsequent waveform segment address is selected, reading samples stored in memory between the current address and the subsequent waveform segment address.

10. A method according to claim 1 wherein the step of reading includes reading sequential samples of waveform segments stored in memory by sequentially selecting as a current address an address associated with a current waveform segment, reading the value of the sample stored in the memory at the current address, and sequentially incrementing the current address to the address of another sample and reading the incremented address; and when the end address of each subsequent waveform segment is sequentially precedent in the memory from the current address at the time the subsequent waveform segment address is selected, reselecting the end address of the previous waveform segment, and reading the samples stored in memory between the current address and the reselected end address and then reading samples of the selected waveform segment between the start and reselected end addresses, until the next waveform segment start and stop addresses are selected.

11. A method according to claim 10 wherein the step of selecting the start and end addresses includes selecting the start and end addresses at periodic intervals of time.

12. A method of randomly reading waveform segments of a waveform stored in memory of a digital electronic musical instrument comprising the steps of:

storing in a memory of an electronic musical instrument at sequential addresses a waveform having a plurality of cycles, with each cycle having a plurality of addressable samples, each cycle being identified by a start address and an end address;

randomly selecting both of the start and end addresses of a first waveform segment of the waveform stored in the memory which segment has at least one cycle defined by a start address and an end address;

reading a waveform segment associated with the first waveform segment by sequentially selecting as a current address an address associated with the first waveform segment, reading the value of the sample stored in the memory at the current address, and sequentially incrementing the current address to the address of another sample and reading the incremented current address;

sequentially and randomly selecting both of the start and end addresses of subsequent waveform segments; and when the end address of each subsequent waveform segment is sequentially subsequent in the memory from the current address at the time the subsequent waveform segment address is selected, reading samples stored in memory between the current address and the subsequent waveform segment address; and when the end address of each subsequent waveform segment is sequentially precedent in the memory from the current address at the time the subsequent waveform segment address is selected, reselecting the end address of the previous waveform segment, and reading the samples stored in memory between the current address and the reselected end address and then reading the samples of the selected waveform segment between the start and reselected end addresses, until the next waveform segment addresses are selected.

13. An electronic musical instrument for randomly reading waveform segments comprising:

memory means for storing at sequential addresses a waveform having a plurality of cycles, with each cycle having a plurality of addressable samples, each cycle being identified by a start address and an end address;

means for sequentially randomly selecting a first plurality of waveform segments stored in the memory, with each segment having at least one cycle and being defined by a start address and an end address, by selecting randomly both start and end addresses associated with each waveform segment, with one of the start and end addresses being changed between sequentially adjacent waveform segments more than the other address of the start and end addresses so that sequentially adjacent selected waveform segments exist having at least one common cycle; and means for sequentially reading waveform segments associated with the selected waveform segments.

14. An instrument according to claim 13 wherein the selecting means is further for selecting the number of sequential waveform segments for which the other address will be repeated each time the other of the start and end addresses is changed.

15. An instrument according to claim 14 wherein the selecting means randomly selects the number of sequential waveform segments for which the other address will repeat.

16. An instrument according to claim 15 wherein the selecting means selects the number of sequential waveform segments for which the other address will repeat from within a range of preselected numbers.

17. An instrument according to claim 16 wherein the selecting means randomly selects the other address.

18. An instrument according to claim 13 wherein the selecting means randomly selects the other address.

19. An instrument according to claim 13 wherein the step of selecting the start and end addresses includes selecting the start and end addresses at selected intervals of time independent of the reading of the waveform segments.

20. An instrument according to claim 13 wherein the selecting means selects the start and end addresses at periodic intervals of time.

21. An instrument according to claim 13 wherein the selecting means sequentially selects as a current address an address associated with a current waveform segment, the reading means reads the value of the sample stored in the memory at the current address, the selecting means sequentially increments the current address to the address of another sample, the reading means reads the incremented address, and when the end address of each subsequent waveform segment is sequentially subsequent in the memory from the current address at the time the subsequent waveform segment address is selected, the reading means reads samples stored in memory between the current address and the subsequent waveform segment address.

22. An instrument according to claim 13 wherein the selecting means sequentially selects as a current address an address associated with a current waveform segment, the reading means reads the value of the sample stored in the memory at the current address, the selecting means sequentially increments the current address to the address of another sample, the reading means reads the incremented address, and when the end address of each subsequent waveform segment is sequentially precedent in the memory from the current address at the time the subsequent waveform segment address is selected, the selecting means reselects the end address of the previous waveform segment, and the reading means reads the samples stored in memory between the current address and the reselected end address and then reads samples of the selected waveform segment between the start and reselected end addresses, until the next waveform segment start and end addresses are selected.

23. An instrument according to claim 22 wherein the selecting means selects the start and end addresses at periodic intervals of time.

24. An electronic music instrument for randomly reading waveform segments of a waveform comprising:

memory means for storing at sequential addresses a waveform having a plurality of cycles, with each cycle having a plurality of addressable samples, each cycle being identified by a start address and an end address;

means for randomly selecting both of the start and end addresses of a first waveform segment stored in the memory which segment has at least one cycle defined by a start address and an end address;

means coupled to the memory means and the selecting means for reading waveform segments stored in the memory means by reading sequentially current samples stored in the memory at the current address, including reading initially a waveform segment associated with the first selected waveform segment, the selecting means sequentially selecting as current addresses, addresses associated with the first waveform segment, the reading means reading the values of the samples stored in the memory at the current addresses, the selecting means sequentially incrementing the current address to the address of another sample, the reading means reading the incremented current address, the selecting means sequentially and randomly selecting at least one of the start and end addresses of subsequent waveform segments;

when the end address of each subsequent waveform segment is sequentially subsequent in the memory from the current address at the time the subsequent waveform segment address is selected, the reading means reads samples stored in memory between the current address and the subsequent waveform segment address; and when the end address of each subsequent waveform segment is sequentially precedent in the memory from the current address at the time the subsequent waveform segment address is selected, the selecting means reselecting the end address of the previous waveform segment, and the reading means reads the samples stored in memory between the current address and the reselected end address and then reads the samples of the selected waveform segment between the start and reselected end addresses, until the next waveform segment addresses are selected.

25. A method according to claim 1 for generating stereo sounds in a digital electrical musical instrument having a speaker for each of two audio signals, the method further comprising:

sequentially randomly selecting a second plurality of such waveform segments different from the first plurality of such waveform segments; reading the waveform segments associated with the second plurality of waveform segments; and generating a separate audio signal for each of the first and second plurality of read waveform segments.

26. An instrument according to claim 13 for generating stereo sounds further comprising:

a speaker for each of two audio signals:

means for sequentially randomly selecting a second plurality of such waveform segments different from the first plurality of such waveform segments;

means for reading waveform segments associated with the second plurality of selected waveform segments; and means for generating a separate audio signal for each of the first and second plurality of read waveform segments.

* * * * *